US007448245B2

(12) United States Patent
Muschalik et al.

(10) Patent No.: US 7,448,245 B2
(45) Date of Patent: Nov. 11, 2008

(54) EXTRUDING PRESS FOR BILLETS AND TUBES

(75) Inventors: Uwe Muschalik, Duisburg (DE); Valentin Gala, Mönchengladbach (DE); Wilfried Geven, Neuss (DE)

(73) Assignee: SMS Eumuco GmbH, Leverkusen (DE)

( * ) Notice: Subject to any disclaimer, the term of this patent is extended or adjusted under 35 U.S.C. 154(b) by 7 days.

(21) Appl. No.: 11/579,827

(22) PCT Filed: Apr. 28, 2005

(86) PCT No.: PCT/DE2005/000785

§ 371 (c)(1),
(2), (4) Date: Nov. 7, 2006

(87) PCT Pub. No.: WO2005/110636

PCT Pub. Date: Nov. 24, 2005

(65) Prior Publication Data

US 2008/0022744 A1 Jan. 31, 2008

(30) Foreign Application Priority Data

May 10, 2004 (DE) ..... 10 2004 023 611

(51) Int. Cl.
*B21C 23/00* (2006.01)

(52) U.S. Cl. ..... 72/253.1; 72/257; 72/270

(58) Field of Classification Search ..... 72/253.1, 72/255, 257, 270, 273.5
See application file for complete search history.

(56) References Cited

U.S. PATENT DOCUMENTS

| | | | | | |
|---|---|---|---|---|---|
| 3,416,349 | A | * | 12/1968 | Kent et al. | 72/270 |
| 3,616,672 | A | * | 11/1971 | Moos | 72/270 |
| 3,818,745 | A | * | 6/1974 | Pollak et al. | 72/270 |
| 4,484,466 | A | * | 11/1984 | Groos et al. | 72/255 |
| 4,606,211 | A | * | 8/1986 | Noyori et al. | 72/270 |
| 4,825,677 | A | * | 5/1989 | Bessey et al. | 72/270 |
| 5,823,038 | A | * | 10/1998 | Jakoby | 72/270 |

FOREIGN PATENT DOCUMENTS

EP 0 428 989 5/1991

* cited by examiner

*Primary Examiner*—Edward Tolan
(74) *Attorney, Agent, or Firm*—Andrew Wilford

(57) ABSTRACT

Disclosed is an extruding press (1) for billets and tubes, comprising a press frame (2) which is composed of a cylinder-type bar (3) and an opposite bar (6) that is connected thereto. A movable running bar (6) and a movable receiving device (7) are disposed within said press frame (2), the receiving device (7) displacing a block (9) that is introduced with the aid of a charging apparatus and is to be pressed in front of the opposite bar (5) encompassing a matrix. A multifunctional robot (12) which can be moved on a linear guide (11), acts independently of the movements of the press, and is equipped with a receptacle head (13) is assigned to the press frame.

5 Claims, 2 Drawing Sheets

EXTRUDING PRESS FOR BILLETS AND TUBES

CROSS REFERENCE TO RELATED APPLICATIONS

This application is the U.S. national phase of PCT application PCT/DE2005/000785, filed 28 Apr. 2005, published 24 Nov. 2005 as WO 2005/110636, and claiming the priority of German patent application 102004023611.9 itself filed 10 May 2004.

FIELD OF THE INVENTION

The invention relates to an extruding press for billets and tubes, comprising a press frame that is composed of a cylindrical end part and an opposite end part that are connected together, in which press frame a movable running beam and a movable holder are mounted, the holder displacing a block that is fed in by a loader and is to be pressed, into a pressing position in front of the opposite end part that holds a die.

A horizontal or recumbent metal extrusion press of this type is known from EP 0 428 989 A2. A billet that has been heated to the extrusion temperature in a furnace is taken over by loading jaws and moved into the free space between the die and the pusher disk by swivel arms mounted non-rotatably on a shaft—a so-called swivel holder as an alternative to also commonly found linear billet holders—into the press axis. Adjusting cylinders shift the running beam and the billet holder toward the die, the billet holder being folded over the billet. In accordance with the advance of the billet holder, the axially movable swivel arm is displaced on the shaft until the billet is clamped between the extrusion die or mandrel and the opposite end part and/or the die fastened in a mount. The holder is shifted by lateral cylinders.

Extruding presses for billets and tubes of this type are fairly well known and operate based on various pressing methods, for example for the extrusion of tubes with a stationary mandrel, as used preferably for aluminum and particularly for the manufacture of small tubes. During indirect and direct extrusion, it is possible to punch the billet in the extruding press (see, for example ALUMINUM 49 (1973) 4, pages 296 to 299).

For operation of the press, all known extruding presses for billets and tubes are provided with a plurality of different, suitable fixtures for handling the auxiliary movements, for example loading the disks or tool heads, removing scrap, typically with shears and shell disposal, mandrel loading and unloading, and billet loading and removal. These are mostly positioned around the extruding press and/or in the periphery thereof, for example on the movable components thereof, such as the running beam, holder retainer or the like, or they are provided in a stationary manner on the press frame, the cylindrical end part and opposite end part of which are typically force-fitted to each other via upper and lower prestressed tension rods as well as upper and lower pressure supports.

The plurality of fixtures that are required is not only associated with high construction efforts that additionally also affect the surroundings of the extruding press, but due to failures, which are relatively frequent, also require separate maintenance and repair periods. The entire system therefore offers little flexibility, the individual fixtures being frequently also coupled to the movements of the press.

OBJECT OF THE INVENTION

It is therefore the object of the invention to create an extruding press for billets and tubes of this type without the above-described disadvantages, particularly to allow improved operation with greater flexibility.

SUMMARY OF THE INVENTION

This object is achieved according to the invention in that the press frame is associated with a multifunction robot that can be displaced on a linear guide, acts independently of the movements of the press, and is provided with a replaceable head. As a result, all auxiliary movements and/or handling steps can be carried out easily due to the multifunction robot that is displaceable in all axes and equipped with a replaceable head. This is achieved regardless of the press type and the material that is used (light alloy or heavy metal), since in any case only the replaceable head that is configured for a specific profile has to be replaced if the grippers of the replaceable head should no longer be sufficient for a new, larger diameter range, which means are, for example, jaws that are variably adjustable in their movement to a certain limit, with optionally deviating, perhaps mutually complementing movement processes of the individual jaws. The robot is then only displaced into the position provided for the task at hand and positioned there. All the other surroundings of the press remain unobstructed and the process no longer requires any further interfering handling fixtures that may be prone to malfunctions. The linear guide for the universal robot may be provided directly or indirectly on the press frame.

BRIEF DESCRIPTION OF THE DRAWING

Further characteristics and details of the invention are apparent from the description provided hereinafter with reference to the schematic illustration of illustrated embodiments shown in drawings, where.

SPECIFIC DESCRIPTION

Figure 1:
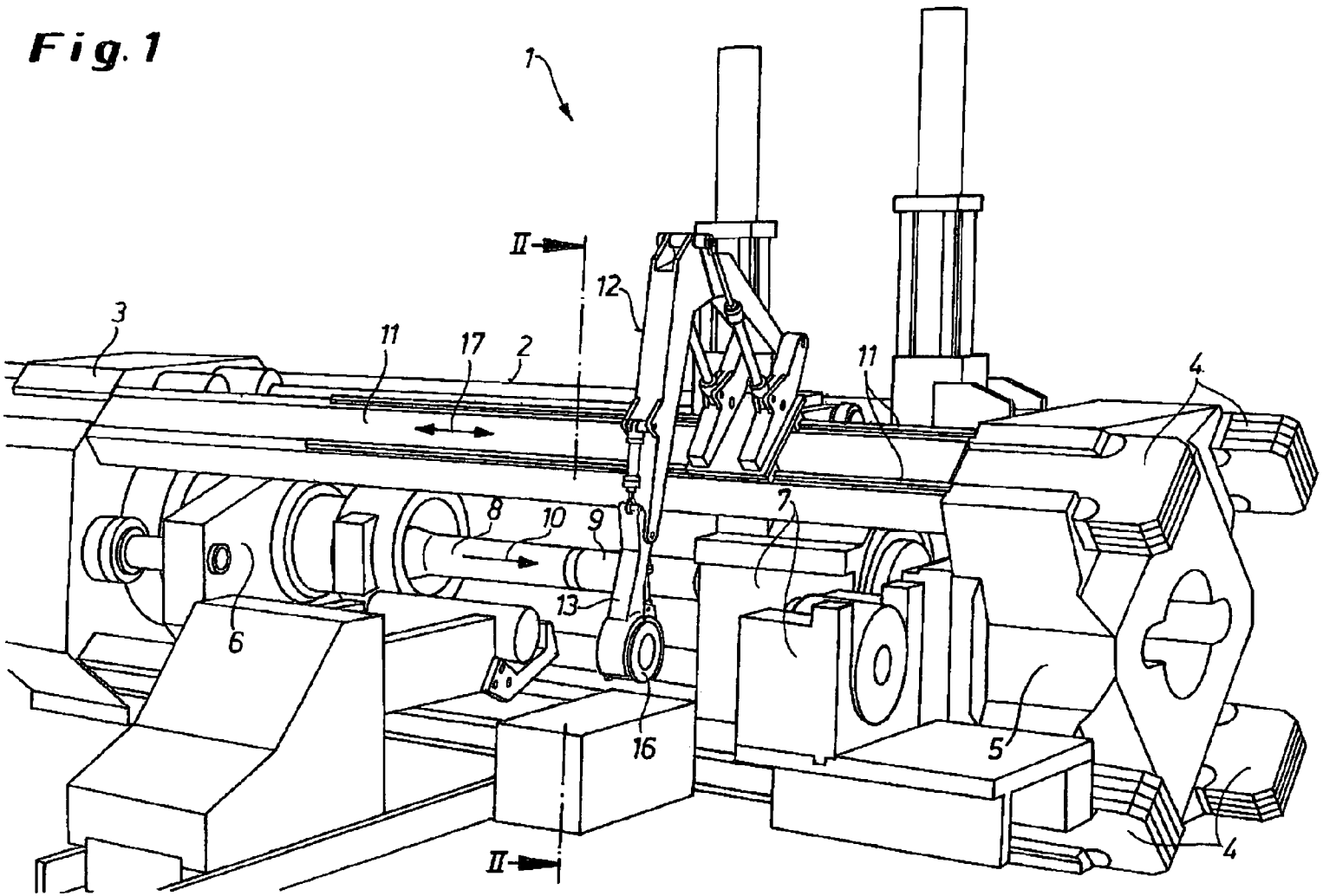
FIG. 1 is a partially sectional, perspective overall view of an extruding press viewed from one side.
Figure 2:
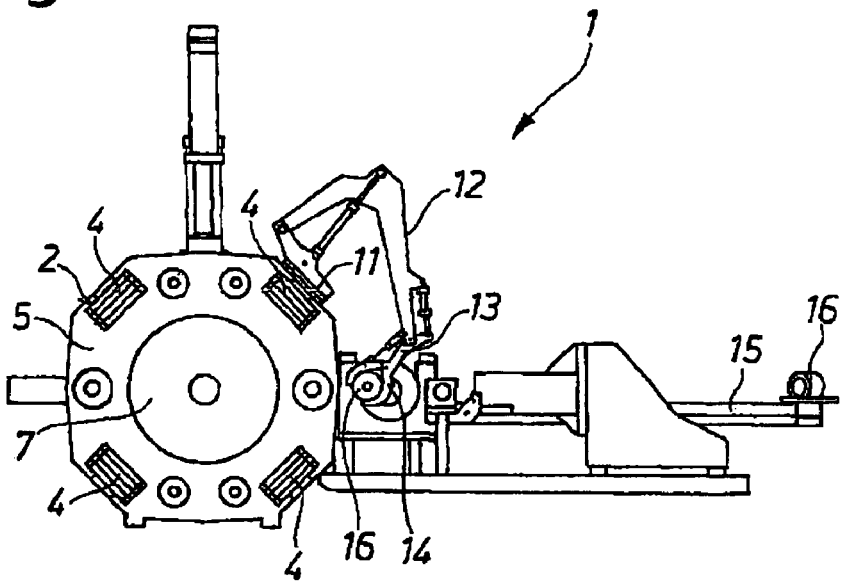
FIG. 2 is the extruding press for billets and tubes according to FIG. 1 in a cross-sectional view along line II-II and FIG. 3 is the extruding press for billets and tubes according to FIG. 2 in a view from above.

A horizontal extruding press 1 shown in the illustrated embodiment comprises a compact press frame 2 forming the press rack. It comprises a cylindrical end part 3 connected via four tension rods 4 (see also FIG. 2) with an opposite end part 5 that is schematically illustrated. To establish a force-fit connection of these components, furthermore also pressure supports may be provided. In the press frame 2, a movable running beam 6 and a movable billet holder 7 are provided. As FIG. 1 shows, during operation of the press a press mandrel 8 connected to the running beam 6 pushes a previously loaded billet 9 in the press direction 10 initially into the billet holder 7 and then through a shaping die so that the extruded profile exits from the opposite end part 5 and during straightening reaches a conveyor provided at the outlet end of the press.

Figure 3:
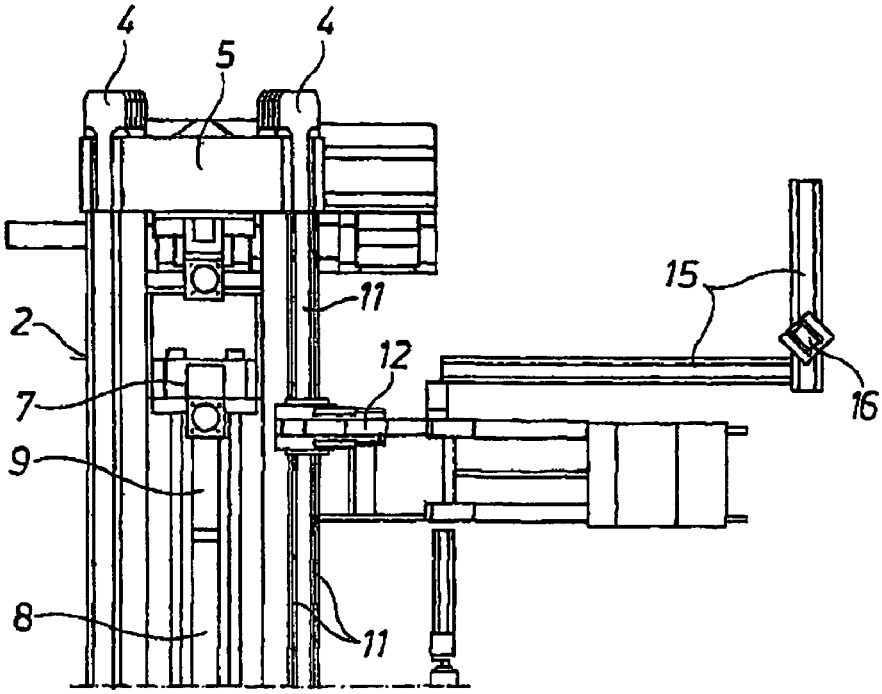

A track or linear guide 11 (see FIGS. 1 and 2) of the press frame 2 carries a robot 12 that can move about all axes and that for operation is provided with a replaceable head 13 that in the illustrated embodiment is equipped with grippers 14 (see FIG. 2) for seizing pusher disks 16 that are fed via a feeder 15 (see FIG. 3). The robot 12 with the replaceable head

13 provided in this example specially for loading and unloading pusher disks 16—for which purpose the robot 12 has been moved to the location provided in the extruder and has been positioned there—can be used universally for all handling and/or auxiliary movements and activities. The replaceable head 13 only has to be replaced with one whose grippers or equivalent means are configured such that it can load a billet 9 to be pressed or load and unload the press mandrels 8. This occurs in each case after appropriate prior positioning by displacing and fixing it on the linear guide 11 that allows an unlimited range of operating positions, on which guide the robot 12 can be displaced in the direction of the double arrow 17 in the desired direction. It is also possible to provide a replaceable head 13 that is equipped, for example, with shears or a scraper to remove scrap in front of the die or a shell remaining in the billet holder 7.

The surrounding area of the extruding press 1 is not obstructed since the multifunction robot 12, which can be universally converted and arbitrarily positioned, can carry out all required auxiliary movements and/or handling steps with an appropriately replaced head 13 or a head that is adapted through the settings of the gripper, to which end the robot acts completely independently of the movements of the press, so that it can be prepared and positioned for a subsequent task even while the prior pressing operation is still in progress.

The invention claimed is:

1. An extruding press for billets and tubes, the press comprising a press frame having a pair of longitudinally spaced end parts that are longitudinally fixed relative to each other and one of which is provided with a die through which a billet can be extruded;

a running beam and a holder longitudinally shiftable between the end parts and capable of positioning a billet against the die and longitudinally forcing it through the die;

a longitudinal guide extending along the frame between the ends; and a multifunction robot longitudinally shiftable along the guide independently of the beam and holder and having a replaceable head engageable with the billet and part of the beam and holder for servicing and positioning same.

2. The extruding press for billets and tubes according to claim 1 wherein the replaceable head is configured for the loading of billets to be pressed.

3. The extruding press for billets and tubes according to claim 1 wherein the replaceable head is configured for the loading and unloading of pusher disks.

4. The extruding press for billets and tubes according to claim 1 wherein the replaceable head is configured for the loading and unloading of press mandrels.

5. The extruding press for billets and tubes according to claim 1 wherein the replaceable head is provided with means for removing press scrap or shells.

* * * * *